US009386899B2

(12) United States Patent
Yang

(10) Patent No.: US 9,386,899 B2
(45) Date of Patent: Jul. 12, 2016

(54) FOLDABLE DUSTER

(71) Applicant: Ya-Ching Yang, Taipei (TW)

(72) Inventor: Ya-Ching Yang, Taipei (TW)

( * ) Notice: Subject to any disclaimer, the term of this patent is extended or adjusted under 35 U.S.C. 154(b) by 0 days.

(21) Appl. No.: 13/747,478

(22) Filed: Jan. 23, 2013

(65) Prior Publication Data

US 2014/0201936 A1 Jul. 24, 2014

(51) Int. Cl.

| | |
|---|---|
| ***A47L 13/38*** | (2006.01) |
| ***A47L 13/255*** | (2006.01) |
| ***A47L 13/258*** | (2006.01) |
| ***A47L 13/24*** | (2006.01) |
| ***A47L 13/46*** | (2006.01) |

(52) U.S. Cl.

CPC ..... *A47L 13/38* (2013.01); *A47L 13/24* (2013.01); *A47L 13/255* (2013.01); *A47L 13/258* (2013.01); *A47L 13/46* (2013.01)

(58) Field of Classification Search

USPC ..... 15/147.1, 147.2, 149, 229.1–229.9

See application file for complete search history.

(56) References Cited

U.S. PATENT DOCUMENTS

| | | | | |
|---|---|---|---|---|
| 2,157,700 | A * | 5/1939 | Hertzberg | 15/147.2 |
| 4,845,800 | A * | 7/1989 | Pederson et al. | 15/228 |
| 7,802,340 | B2 * | 9/2010 | Knopow et al. | 15/144.1 |
| 8,151,403 | B2 * | 4/2012 | Wada et al. | 15/229.4 |
| 8,156,603 | B2 * | 4/2012 | Tsutanaga et al. | 15/229.3 |
| 2007/0180640 | A1 * | 8/2007 | Knopow et al. | 15/210.1 |
| 2008/0282492 | A1 * | 11/2008 | Tomm | 15/250.46 |

* cited by examiner

*Primary Examiner* — Mark Spisich

(74) *Attorney, Agent, or Firm* — Muncy, Geissler, Olds & Lowe, P.C.

(57) ABSTRACT

A foldable duster can be folded to enable selective use of a single-sided or double-sided pile as well as a change in length of the duster. The duster includes a stationary member whose two ends form a pivotally connecting portion and a fastening portion respectively. The fastening portion is configured for connecting with a handle. The pivotally connecting portion is pivotally connected with a folding member. A dusting sleeve coated with pile threads is mounted around the stationary member and the folding member. The folding member can be swung to a position where the folding member and the stationary member form a straight line, thereby straightening the dusting sleeve and extending the duster to its full length. When the folding member is swung to overlap the stationary member, the dusting sleeve becomes folded, and the duster is shortened. Thus, the foldable duster provides convenience of use.

12 Claims, 16 Drawing Sheets

(A-A)

FOLDABLE DUSTER

BACKGROUND OF THE INVENTION

1. Technical Field

The present invention relates to a foldable duster. More particularly, the present invention relates to a duster which can be folded to enable selective use of a single-sided or double-sided pile as well as a change in length of the duster. Even more particularly, the present invention relates to a handle, a stationary member, a folding member, and a dusting sleeve that constitute such a duster.

2. Description of Related Art

A conventional duster consists essentially of a dusting sleeve capable of picking up dust and a shank for supporting and securing the dusting sleeve, wherein the dusting sleeve has a pile layer or a cloth strip layer on its surface. Before use, one end of the shank is inserted into the interior space of the dusting sleeve, and the tail end of the dusting sleeve is hooked to a barb provided in the middle section of the shank. Thus, the dusting sleeve is extended and straightened. The user can then hold and wave the rear end of the shank in order to pick up dust with the pile layer or cloth strip layer on the surface of the dusting sleeve. When dirty, the dusting sleeve can be directly detached from the shank and replaced by a new one. Now that only the dusting sleeve needs replacement, environmental protection requirements are met.

As is well known, the dusting sleeve of the aforesaid duster picks up dust in two ways. One way is for the fibrous structures of the pile layer to collect dust, and the other way is for the positive charges on the pile layer to attract negatively charged dust.

Commercially available dusters vary in length. Long dusters are ideal for cleaning large-area surfaces but not suitable for cleaning complex surfaces. Short dusters, on the other hand, are ideal for cleaning complex surfaces but not suitable for cleaning large-area surfaces. Besides, the aforesaid pile layer or cloth strip layer is typically evenly arranged on the upper and lower sides of the dusting sleeve such that the shank is covered all over with pile threads or cloth strips. While this configuration facilitates removal of dust from various kinds of dead corners, the pile layer or cloth strip layer on both sides of the dusting sleeve tends to increase the thickness of the dusting sleeve to such an extent that the duster may have problem being inserted into narrow gaps for cleaning.

In view of the above, the market is supplied with dusters having a pile layer or cloth strip layer on only one side. The single-sided design effectively reduces the thickness of a duster, allowing the duster to be inserted into and clean small gaps. However, a single-sided duster cannot pick up dust from various kinds of dead corners as efficiently as a duster having a pile layer or cloth strip layer on both sides. The problems cited above demand solutions from those skilled in the art.

BRIEF SUMMARY OF THE INVENTION

It is an object of the present invention to provide a duster which can be folded to enable selective use of a single-sided or double-sided pile as well as a change in length of the duster, thereby solving the aforesaid problems of the prior art, namely the incapability to clean both large-area surfaces and complex surfaces and the incapability to pick up dust both from various kinds of dead corners and from narrow gaps.

To achieve the above object, the present invention provides a foldable duster including a handle, a stationary member, a folding member, and a dusting sleeve.

The stationary member has two ends which respectively form a pivotally connecting portion and a fastening portion for connecting with the handle.

The folding member is pivotally connected to the pivotally connecting portion.

The dusting sleeve has a sleeve body to be mounted around the stationary member and the folding member. The outer surface of the sleeve body has a pile layer or a cloth strip layer. The folding member can be swung to a position where the folding member and the stationary member are arranged along a straight line. In this position, the dusting sleeve is straightened, and the duster is extended at full length to facilitate the cleaning of a large-area surface. The folding member can also be swung to a position where the folding member overlaps the stationary member. In this position, the dusting sleeve is folded, and the duster is shortened to facilitate the cleaning of complex surfaces.

The handle, the stationary member, and the folding member constitute the shank of the duster. When the folding member is so adjusted that the duster is extended at full length, the pile layer or the cloth strip layer is located on only one side of the stationary member and the folding member and can be easily inserted into a narrow gap along with the stationary member and the folding member in order to clean the gap, or the dusting sleeve can be used to clean a large-area surface. When the folding member is so adjusted that the duster is shortened, the pile layer or the cloth strip layer is located on both sides of the duster. As a result, the duster is covered all over with pile threads or a plurality of cloth strips and can be used not only to remove dust from various kinds of dead corners but also to clean a complex surface.

Thus, according to the present invention, the stationary member and the folding member can be folded in such a way that the pile layer or the cloth strip layer is located on either a single side or both sides of the duster, with a corresponding change in length of the duster. This enables the duster to clean large-area surfaces as well as complex surfaces and to pick up dust from various kinds of dead corners as well as from tiny gaps. Hence, the foregoing problems of the prior art (i.e., the incapability to clean both large-area surfaces and complex surfaces, and the incapability to pick up dust both from various kinds of dead corners and from narrows gaps) are solved, and convenience of use is ensured. In addition, the dusting sleeve, when dirty, can be replaced while the handle, the stationary member, and the folding member are kept for further use. As such, the present invention also features environmental friendliness.

Implementation of the present invention is further described as follows.

In one embodiment, the fastening portion has a receiving groove which opens toward the handle. The inner wall of the receiving groove is formed with two symmetrically arranged end openings in communication with the outside. One end of the handle has a connecting portion to be inserted in the receiving groove. The connecting portion is formed with two symmetrically arranged elastic hooks to be respectively and elastically placed in the end openings and thus exposed to the outside. By pressing the hooks, the connecting portion can be disengaged from the receiving groove to facilitate replacement of the handle.

In another embodiment, the present invention further includes the following technical features:

The two ends of the folding member have a distal end portion and a pin portion respectively. The folding member is pivotally connected to the pivotally connecting portion by means of the pin portion. The pin portion has two ends which are respectively formed with a first fastening groove and a second fastening groove. The first fastening groove opens in a direction away from the distal end portion, and the second fastening groove opens toward the distal end portion.

A channel is formed in the stationary member and is in communication between the pivotally connecting portion and a portion of the duster that is adjacent to the handle.

A guide aperture is formed on the duster at a position adjacent to the handle and is in communication with the channel.

A supporting rod is slidably provided in the channel and is elastically biased toward the pivotally connecting portion. Thus, the supporting rod can pass through the pivotally connecting portion and be elastically inserted into the first fastening groove or the second fastening groove to prevent the folding member from swinging.

A trigger element is provided on the supporting rod and is exposed to the outside through the guide aperture so as to be triggered by a human hand. Once triggered, the trigger element drives the supporting rod to disengage from the first fastening groove or the second fastening groove in a direction away from the pivotally connecting portion, thereby releasing the folding member and allowing the folding member to swing.

In still another embodiment, the present invention further includes the following technical features:

The receiving groove is formed in the duster at a position adjacent to the handle and is in communication between the channel and the guide aperture.

An upwardly-oriented inclined surface is provided on a top portion of the supporting rod, faces the folding member, and lies in the receiving groove.

A downwardly-oriented inclined surface is provided on a bottom portion of the trigger element and faces the handle. The trigger element is slidably provided on the upwardly-oriented inclined surface of the supporting rod via the downwardly-oriented inclined surface. When moved downward, the downwardly-oriented inclined surface drives the upwardly-oriented inclined surface and thereby drives the supporting rod to move in a direction away from the pivotally connecting portion.

Preferably, a top portion of the folding member is formed with a positioning hole, and a top portion of the stationary member is formed with an engaging hook to be inserted into the positioning hole.

Preferably, the sleeve body is formed with a through hole corresponding in position to the engaging hook. The engaging hook can extend out of the sleeve body through the through hole such that the sleeve body is fastened to the engaging hook of the stationary member and is fixed in position by means of the through hole.

Preferably, the sleeve body is composed of a first cloth sheet and a second cloth sheet bonded together, with a receiving space formed between the first cloth sheet and the second cloth sheet. One end side of the first cloth sheet and the corresponding end side of the second cloth sheet form a sleeve opening therebetween. The sleeve opening is in communication with the receiving space so that the folding member and the stationary member can be placed into and drawn out of the receiving space through the sleeve opening.

Preferably, the first cloth sheet and the second cloth sheet are bonded together by hot-pressing the peripheries thereof to form a plurality of hot-sealed nodes. Additionally, the receiving space is formed with a width-reduced neck between the hot-sealed nodes on two lateral sides of a middle section of the sleeve body, wherein the width-reduced neck is configured to interfere with movement of the folding member.

Preferably, the pile layer or the cloth strip layer is bonded to a bottom surface of the sleeve body.

Preferably, the periphery of the sleeve body has a contour characterized by alternating ridges and grooves, and the pile threads of the pile layer are distributed in an uneven manner along the contour characterized by the alternating ridges and grooves.

Preferably, the two ends of the folding member have the distal end portion and the pin portion respectively; the folding member is pivotally connected to the pivotally connecting portion by means of the pin portion; the distal end portion forms two insertion legs extending in a direction away from the pin portion; the sleeve body has the receiving space therein; one end of the receiving space is formed with the sleeve opening, which is located at an end side of the sleeve body, so that the folding member and the stationary member can be placed into and drawn out of the receiving space through the sleeve opening; and the other end of the receiving space is formed with two end grooves which are divided from each other and are configured to be inserted by the insertion legs respectively.

Preferably, the sleeve body is hot-pressed to form a plurality of hot-sealed nodes corresponding in position to the area between the insertion legs. These hot-sealed nodes form a dividing portion for dividing the end grooves from each other. In addition, a positioning hole is formed between the insertion legs and corresponds in position to the dividing portion. A top portion of the stationary member is formed with an engaging hook which can be inserted into the positioning hole along the dividing portion.

Preferably, the end of the folding member that is away from the pivotally connecting portion forms a bent portion.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
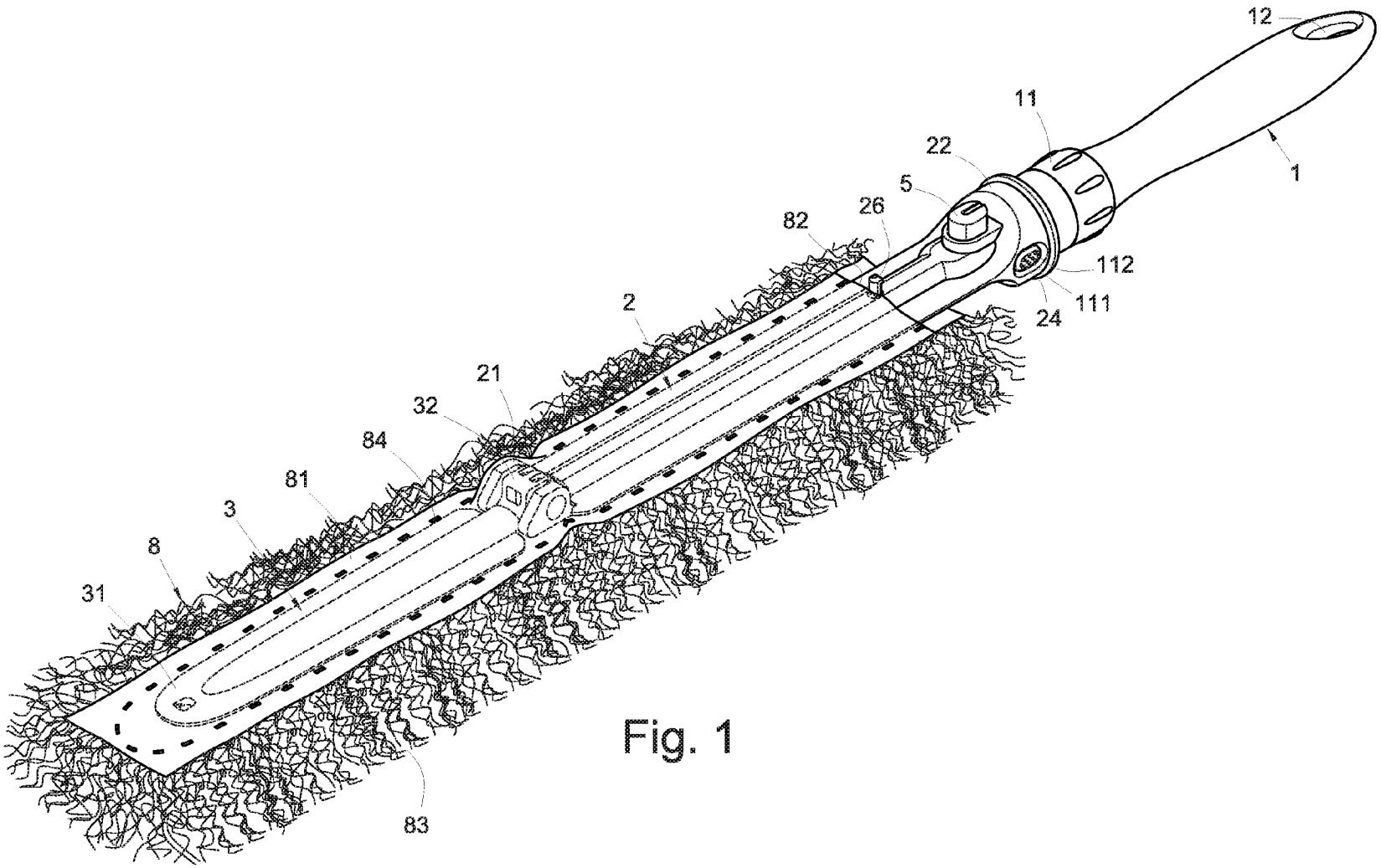
FIG. 1 is a perspective view of the first embodiment of the present invention.
Figure 2:
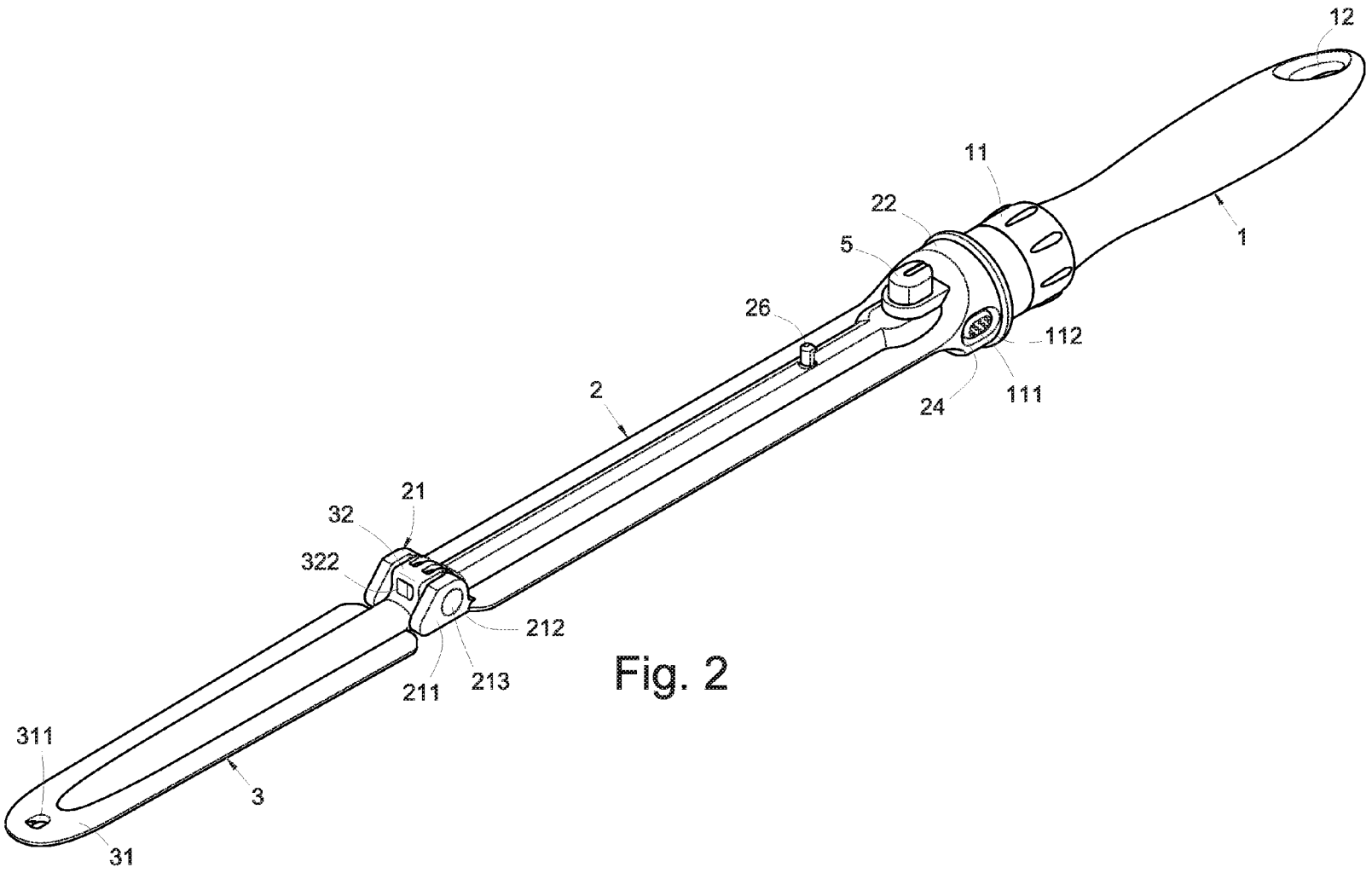
FIG. 2 is a perspective view of the shank shown in FIG. 1.
Figure 3:
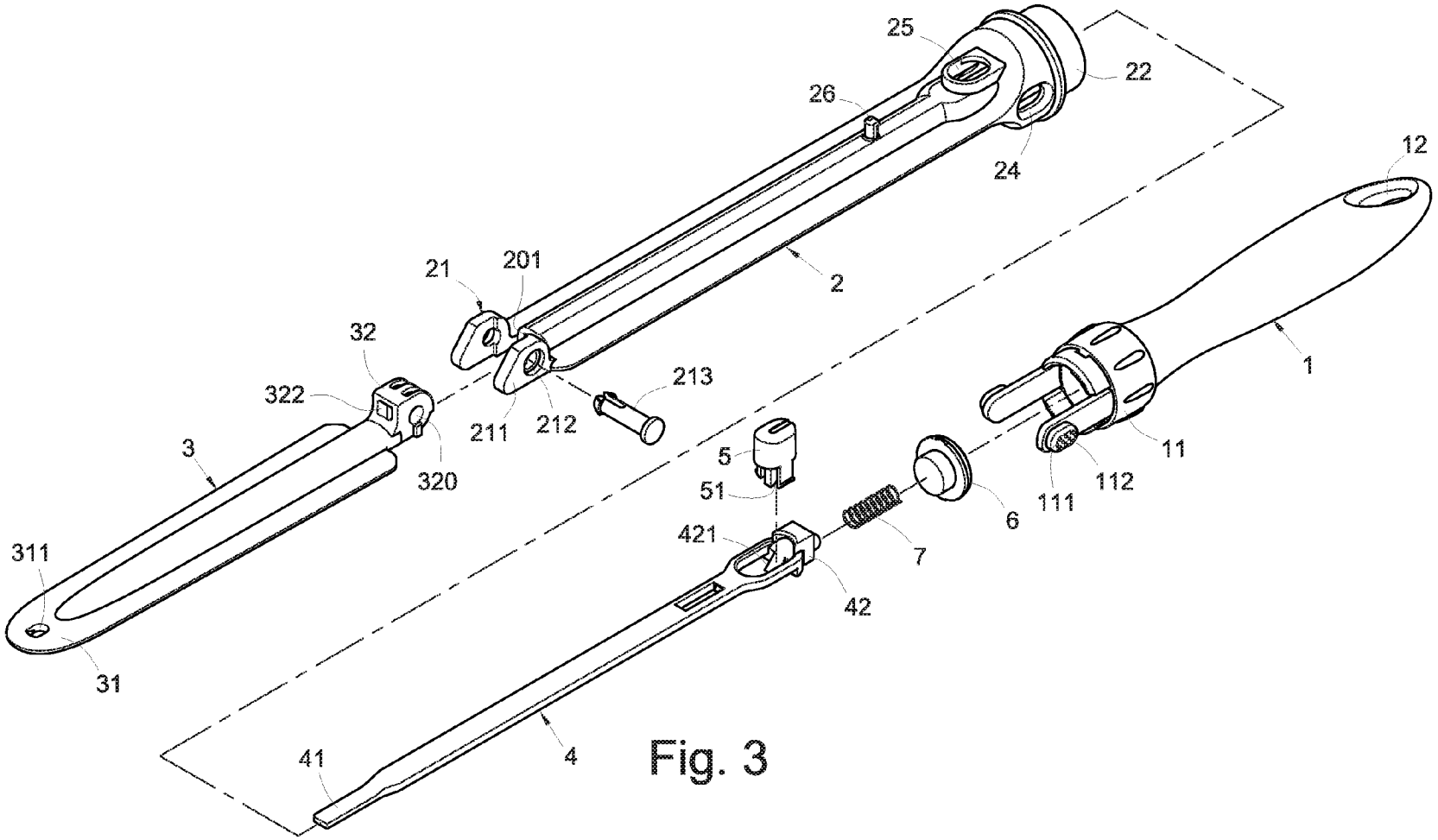
FIG. 3 is an exploded perspective view of FIG. 2.
Figure 4:
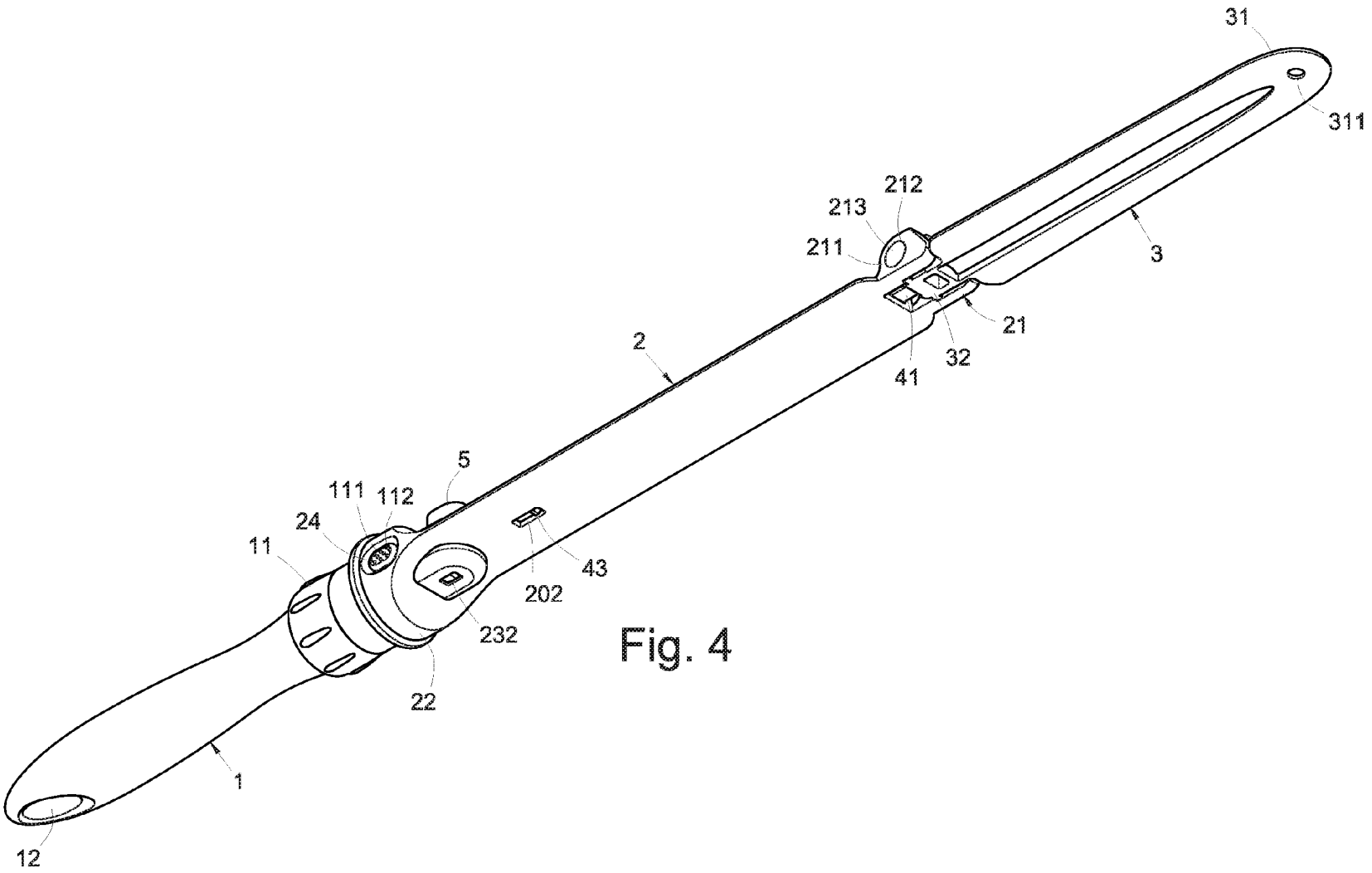
FIG. 4 is a bottom perspective view of FIG. 2.
Figure 5:
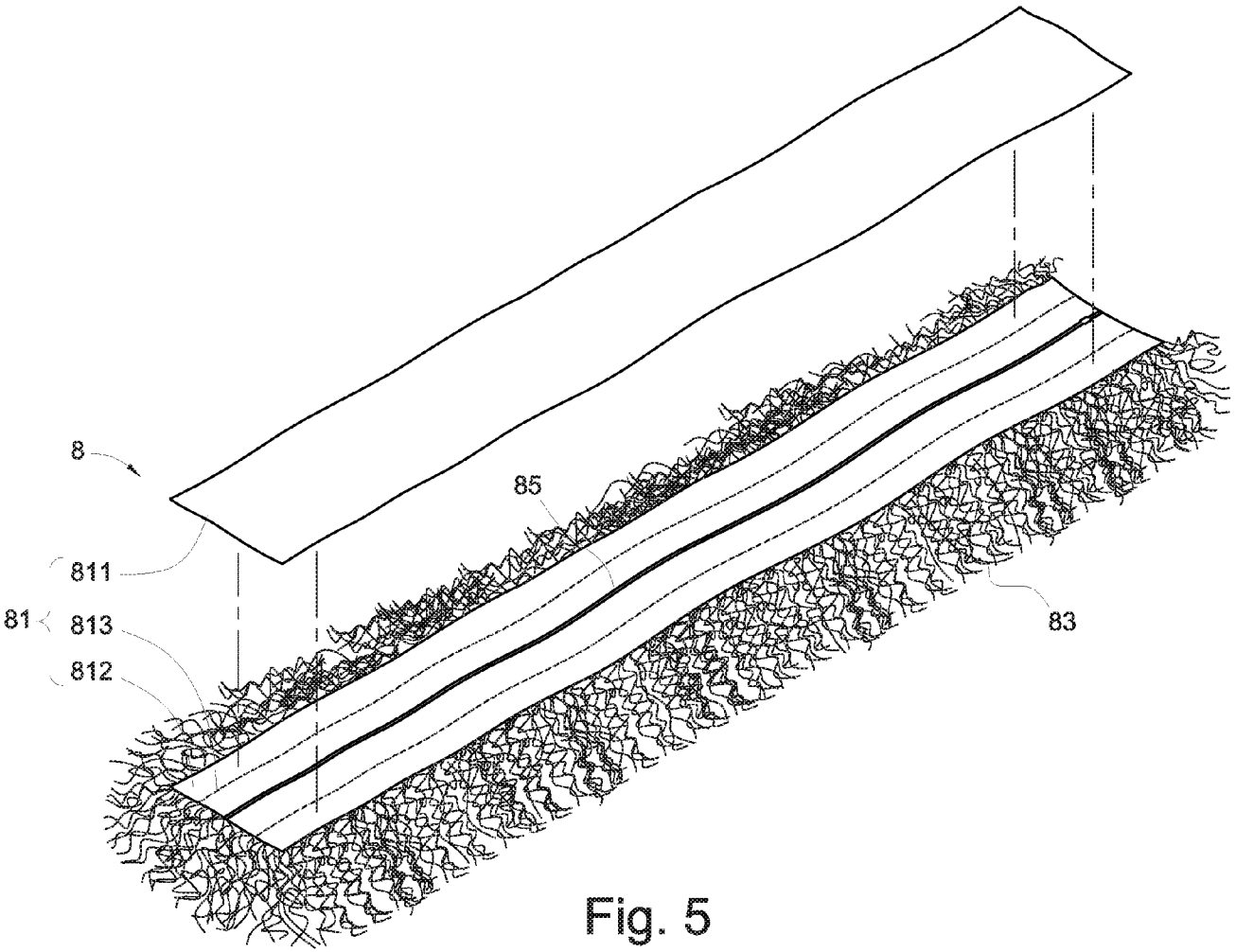
FIG. 5 is an exploded perspective view of the dusting sleeve shown in FIG. 1.
Figure 6:
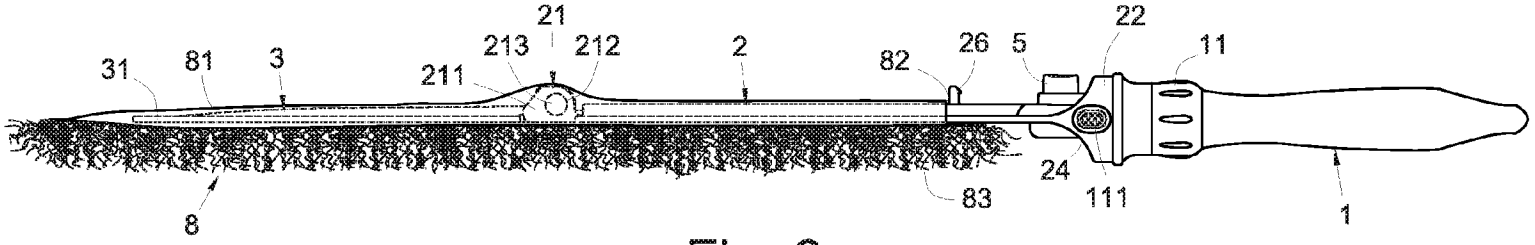
FIG. 6 is a front view of FIG. 1.
Figure 7:
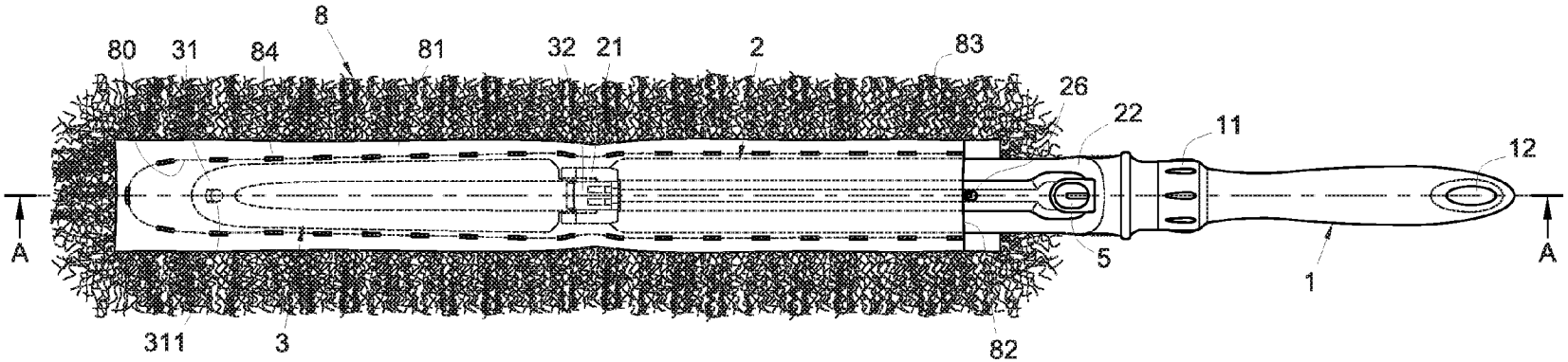
FIG. 7 is a top view of FIG. 6.

FIG. 1 discloses the first embodiment of the present invention in perspective view. Referring to FIG. 1 in conjunction with FIG. 2 to FIG. 8, a foldable duster according to the present invention includes a handle 1, a stationary member 2, a folding member 3, a central channel 20, a guide aperture 25, a supporting rod 4, a trigger element 5, and a dusting sleeve 8.

The handle 1 has a hollow elongated cylindrical configuration. The two ends of the handle 1 form a connecting portion 11 and a hanging hole 12 respectively. The connecting portion 11 is formed with two symmetrically arranged elastic hooks 111 extending toward the stationary member 2. The duster can be hung at a high position by the hanging hole 12 of the handle 1.

The stationary member 2 has a flat and elongated shape. The two ends of the stationary member 2 form a pivotally connecting portion 21 and a fastening portion 22 respectively, wherein the fastening portion 22 is configured for connecting with the connecting portion 11 of the handle 1. More particularly, the fastening portion 22 is formed with a receiving groove 23 which opens toward the handle 1 and whose inner wall is formed with two symmetrically arranged end openings 24. The end openings 24 extend all the way to the outer wall of the fastening portion 22 and communicate with the outside. The receiving groove 23 in this embodiment is formed inside the duster at a position adjacent to the handle 1.

The connecting portion 11 can be inserted into the receiving groove 23 through a groove opening 231 of the receiving groove 23 until the hooks 111 are respectively and elastically placed in the end openings 24 and thus exposed to the outside. In addition, the exposed surface of each hook 111 may be formed with a plurality of studs 112 to facilitate pressing by a finger. When it is desired to replace the handle 1, the hooks 111 can be pressed so as to be disengaged from their respective end openings 24, thereby allowing the connecting portion 11 to move out of the receiving groove 23.

The folding member 3 has a flat and elongated shape. The two ends of the folding member 3 form a distal end portion 31 and a pin portion 32 respectively. The folding member 3 is pivotally connected to the pivotally connecting portion 21 of the stationary member 2 via the pin portion 32. More specifically, the pivotally connecting portion 21 has two symmetrically arranged supporting plates 211, each formed with a pivot hole 212, and a pin 213 is pivotally provided in the pivot holes 212. The pin portion 32 is movably arranged between the supporting plates 211 and has an axial hole 320 which extends between two lateral sides of the pin portion 32 and in which the pin 213 is pivotally provided. The handle 1, the stationary member 2, and the folding member 3 form the shank of the duster.

The pin portion 32 of the folding member 3 has two ends which are formed with a first fastening groove 321 (see FIG. 9) and a second fastening groove 322 respectively. The first fastening groove 321 opens in a direction away from the distal end portion 31 whereas the second fastening groove 322 opens toward the distal end portion 31.

Figure 12:
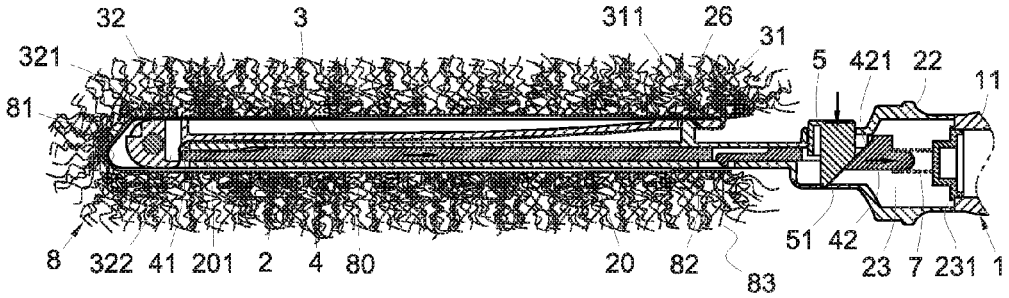
FIG. 12 is a sectional view similar to FIG. 8 but showing a different state of use.

The folding member 3 can be swung to a position in which the folding member 3 and the stationary member 2 are arranged along a straight line and in which, therefore, the duster is extended at full length. The folding member 3 can also be swung to a position in which the folding member 3 overlaps the stationary member 2 and in which, therefore, the duster is shortened (see FIG. 12).

The central channel 20 is formed in the stationary member 2 and is in communication between the pivotally connecting portion 21 and a portion of the duster that is adjacent to the handle 1. Thus, an opening 201 facing the pin portion 32 is formed between the supporting plates 211.

When the folding member 3 and the stationary member 2 are arranged along a straight line, the first fastening groove 321 corresponds in position to the opening 201. When the folding member 3 overlaps the stationary member 2, the second fastening groove 322 corresponds in position to the opening 201.

Figure 10:
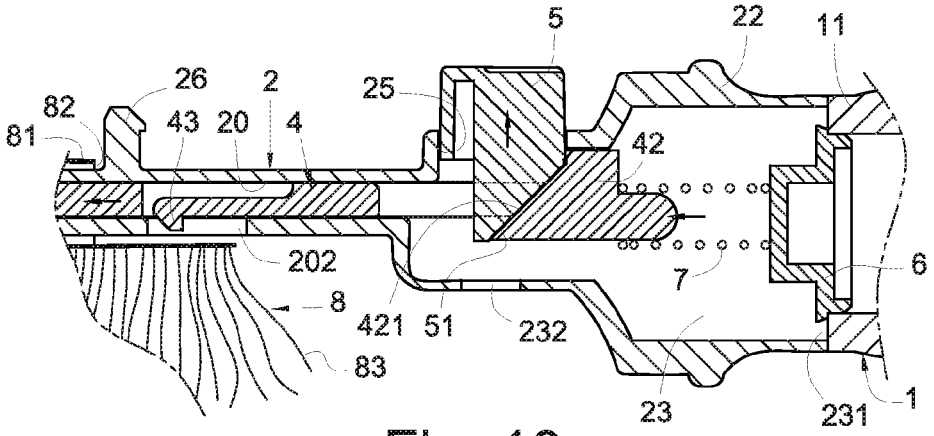
FIG. 10 is a partial enlarged sectional view of FIG. 8.

The guide aperture 25 is formed on a top portion of the duster, is adjacent to the handle 1 (see FIG. 10), and is in communication with the channel 20. More specifically, the guide aperture 25 is formed on a top surface of the fastening portion 22 of the stationary member 2, and the receiving groove 23 is in communication between the channel 20 and the guide aperture 25.

The supporting rod 4 has an elongated shape. The two ends of the supporting rod 4 form an engaging portion 41 and a pressing portion 42 respectively. The supporting rod 4 is slidably provided in the channel 20 and is elastically biased toward the pivotally connecting portion 21. This allows the engaging portion 41 of the supporting rod 4 to be elastically inserted into the first fastening groove 321 or the second fastening groove 322 through the opening 201 of the pivotally connecting portion 21, thereby stopping the folding member 3 from swinging. More specifically, a stopper 6 is provided between the groove opening 231 of the receiving groove 23 and the handle 1, and a spring 7 is provided between the pressing portion 42 of the supporting rod 4 and the stopper 6 in the handle 1 in order to bias the supporting rod 4 elastically toward the pivotally connecting portion 21.

The trigger element 5, which is configured as a button, is provided on the supporting rod 4 and exposed to the outside through the guide aperture 25 so as to be triggered by a human hand. Once triggered, the trigger element 5 drives the engaging portion 41 of the supporting rod 4 to disengage from the first fastening groove 321 or the second fastening groove 322 in a direction away from the pivotally connecting portion 21, thus releasing the folding member 3 and allowing the folding member 3 to swing.

More specifically, the present invention further includes an upwardly-oriented inclined surface 421 and a downwardly-oriented inclined surface 51. The upwardly-oriented inclined surface 421 is provided on a top portion of the pressing portion 42 of the supporting rod 4, faces the folding member 3, and lies in the receiving groove 23. The downwardly-oriented inclined surface 51 is provided on a bottom portion of the trigger element 5 and faces the handle 1. The trigger element 5 is slidably provided on the upwardly-oriented inclined surface 421 of the supporting rod 4 via the downwardly-oriented inclined surface 51. Thus, when the trigger element 5 is moved downward, the downwardly-oriented inclined surface 51 drives the upwardly-oriented inclined surface 421 and thereby drives the supporting rod 4 to move in a direction away from the pivotally connecting portion 21.

The dusting sleeve 8 has a sleeve body 81 to be mounted around the stationary member 2 and the folding member 3. One end side of the sleeve body 81 is formed with a sleeve opening 82 through which the folding member 3 and the stationary member 2 can be placed into and drawn out of the sleeve body 81. The outer surface of the sleeve body 81 has a pile layer 83. The sleeve body 81 can be mounted around the stationary member 2 and the folding member 3 by way of the sleeve opening 82.

In this embodiment, the sleeve body 81 is composed of a first cloth sheet 811 and a second cloth sheet 812 bonded together (see FIG. 5), and a receiving space 80 for receiving the folding member 3 and the stationary member 2 is formed between the first and the second cloth sheets 811, 812. The sleeve opening 82 is formed between one end side of the first cloth sheet 811 and the corresponding end side of the second cloth sheet 812 and communicates with the receiving space 80.

The peripheries of the first and the second cloth sheets 811, 812 of the sleeve body 81 are hot-pressed together to form a plurality of hot-sealed nodes 84, and by doing so, the first and the second cloth sheets 811, 812 are bonded as a single unit. The pile layer 83 is provided between a bottom portion of the second cloth sheet 812 of the sleeve body 81 and a cloth strip 813. Moreover, the second cloth sheet 812, the pile layer 83, and the cloth strip 813 are hot-pressed together to form a hot-sealed line 85. Thus, the pile layer 83 is bonded to the bottom surface of the second cloth sheet 812 of the sleeve body 81.

Figure 8:
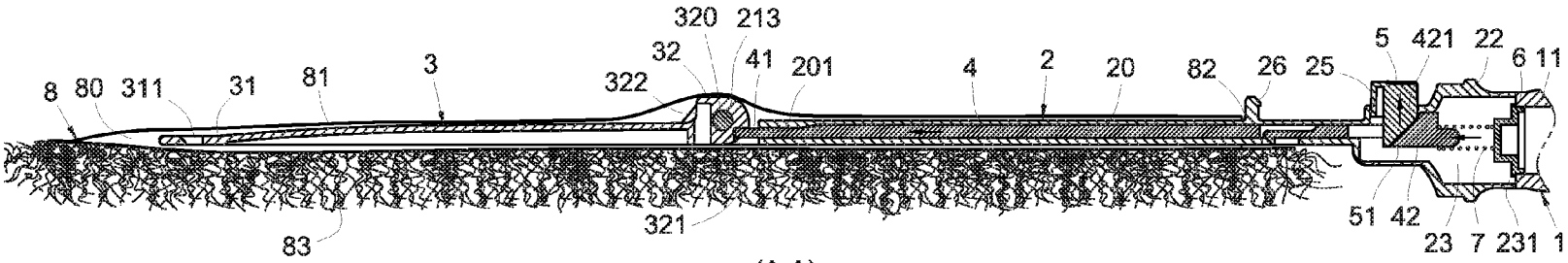
FIG. 8 is a sectional view taken along line A-A of FIG. 7.

The structure described above is so configured that a user may swing the folding member 3 until the folding member 3 and the stationary member 2 are arranged along a straight line (see FIG. 8). Consequently, the dusting sleeve 8 is straightened, and the duster is extended at full length. Meanwhile, the supporting rod 4 is driven toward the pivotally connecting portion 21 by the spring 7 such that the engaging portion 41 of the supporting rod 4 passes through the opening 201 and is elastically inserted into the first fastening groove 321 to stop the folding member 3 from swinging. The pile layer 83 in this state is located on a single side (i.e., a lower side) of the stationary member 2 and the folding member 3, and because of that, the duster has a relatively small thickness. This allows the pile layer 83 to be inserted, together with the stationary member 2 and the folding member 3, into a narrow gap to be cleaned. The dusting sleeve 8 in this state can also be used to clean a large-area surface.

Figure 9:
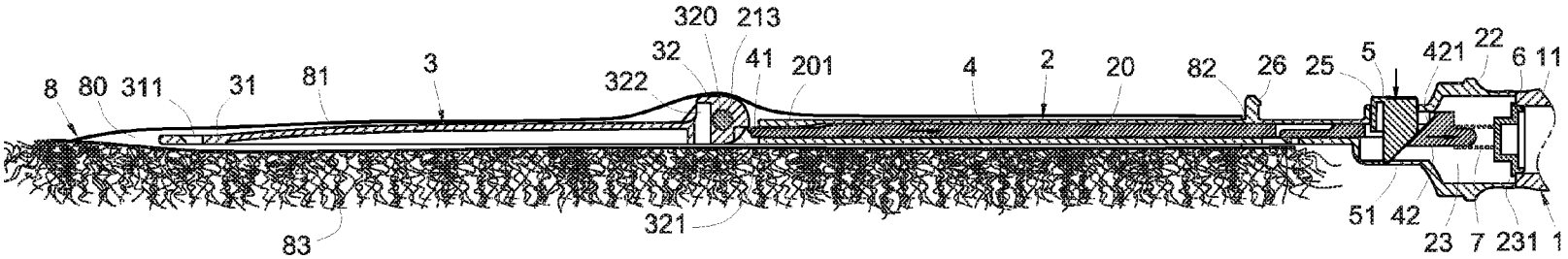
FIG. 9 is a sectional view similar to FIG. 8 but showing a different state of use.
Figure 11:
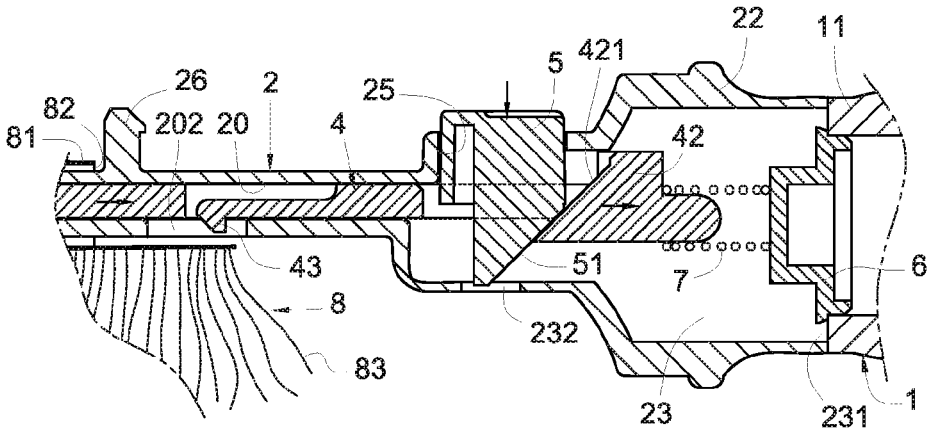
FIG. 11 is a partial enlarged sectional view of FIG. 9.

In use, the trigger element 5 can be pressed as needed (see FIG. 9 and FIG. 11). When the trigger element 5 is moved downward, the downwardly-oriented inclined surface 51 pushes the upwardly-oriented inclined surface 421, causing the upwardly-oriented inclined surface 421 to move along the downwardly-oriented inclined surface 51 in a direction away from the pivotally connecting portion 21. As a result, the engaging portion 41 of the supporting rod 4 is disengaged from the first fastening groove 321 along a direction away from the pivotally connecting portion 21, and the folding member 3 is set free to swing.

Figure 13:
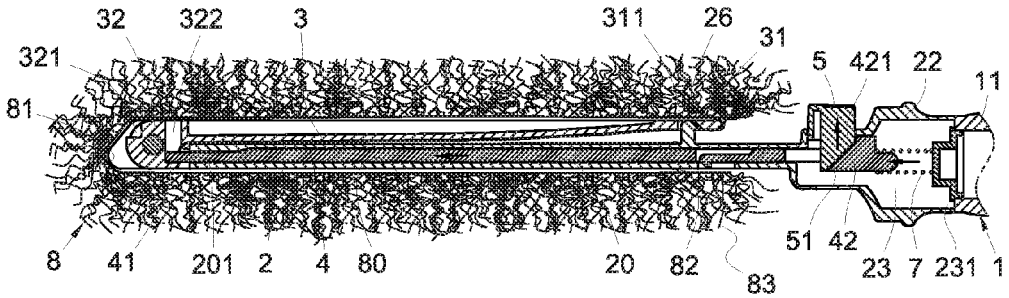
FIG. 13 is a sectional view similar to FIG. 8 but showing yet another state of use.
Figure 14:
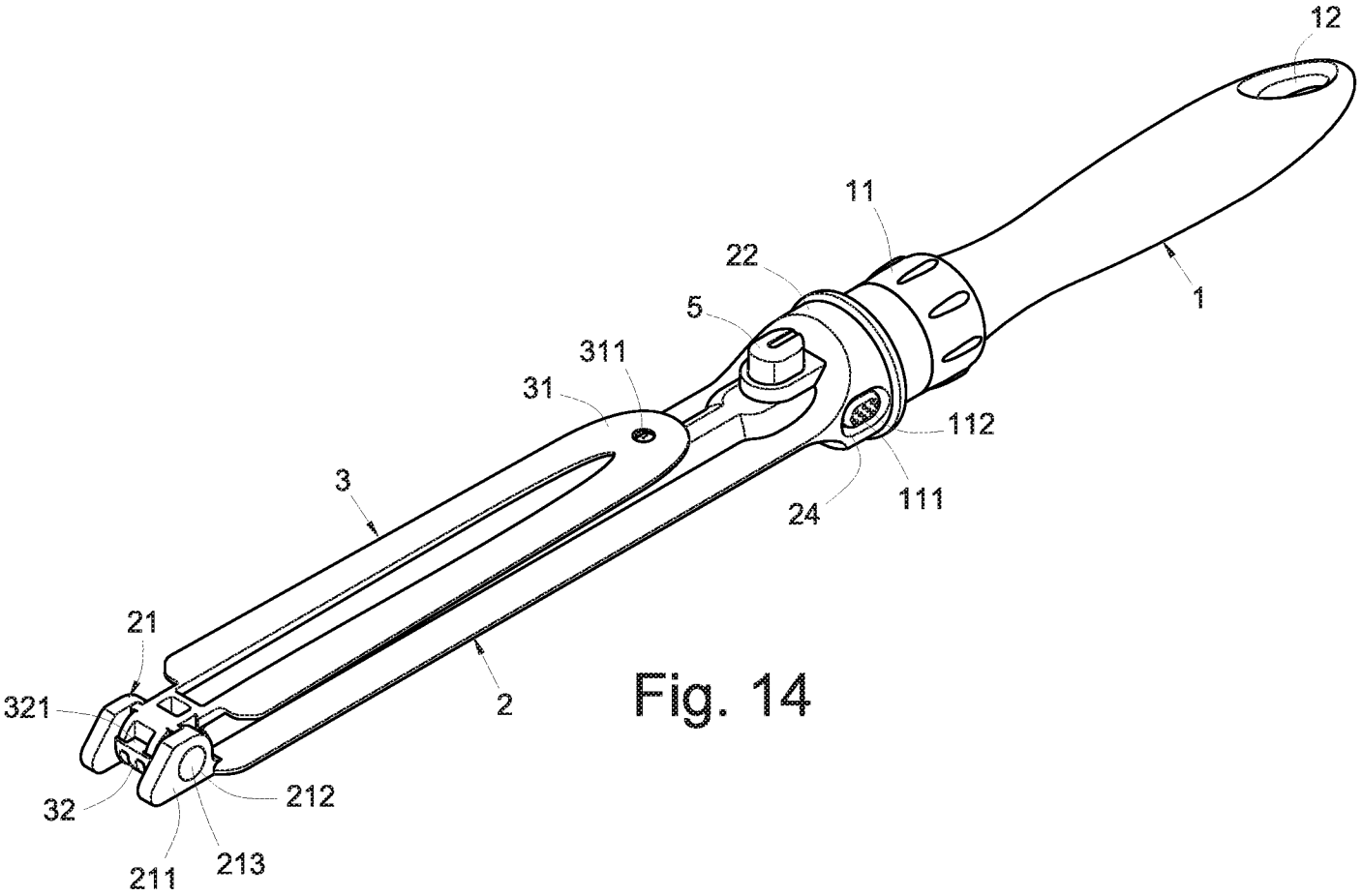
FIG. 14 is a perspective view similar to FIG. 2 but showing a different state of use.
Figure 15:
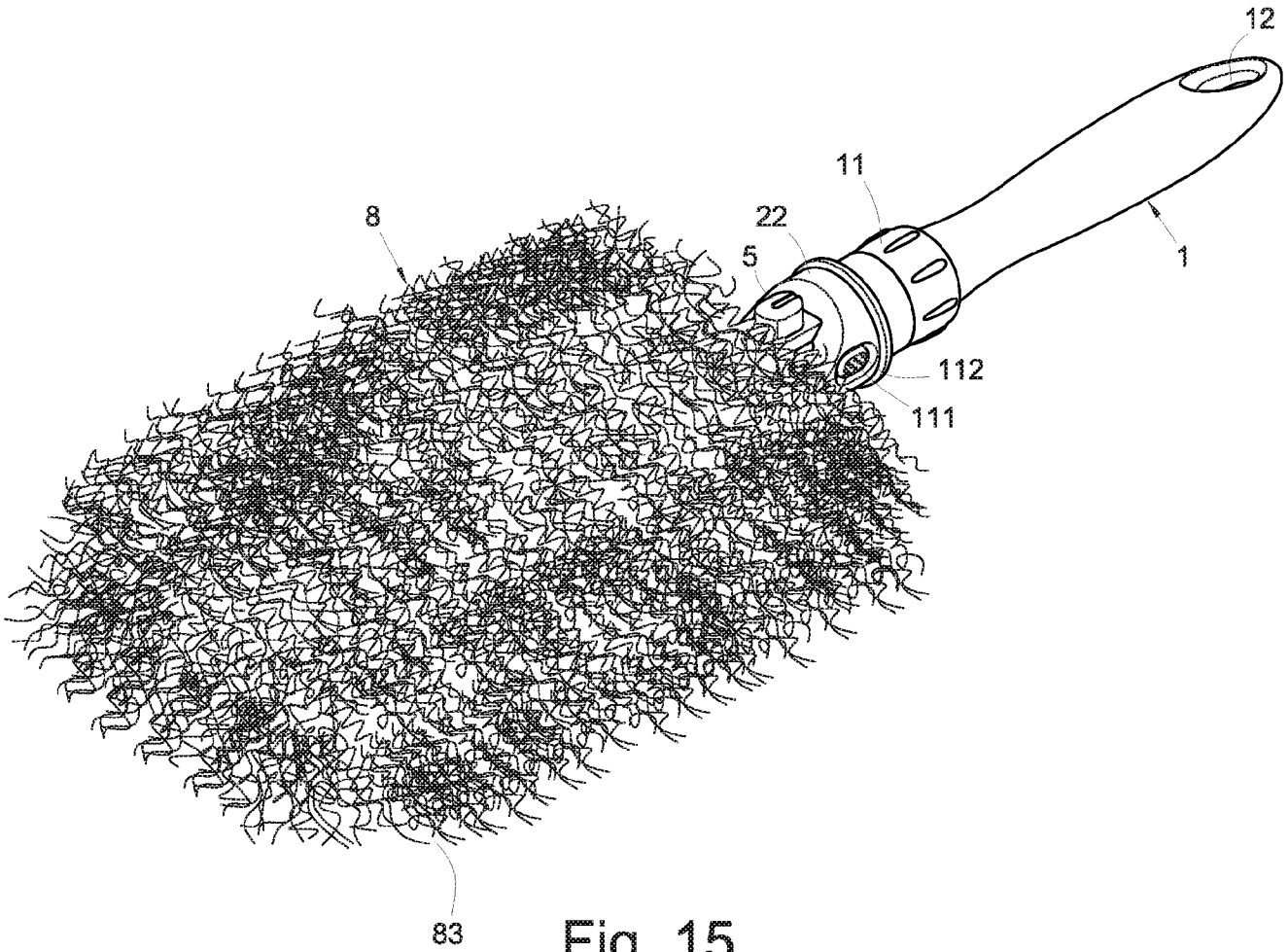
FIG. 15 is a perspective view similar to FIG. 1 but showing a different state of use.

While the trigger element 5 is being pressed, the folding member 3 can be swung to a position in which it overlaps the stationary member 2 (see FIG. 12 and FIG. 14); consequently, the dusting sleeve 8 becomes folded, and the duster is shortened. Once the trigger element 5 is released, the spring 7 once again drives the supporting rod 4 toward the pivotally connecting portion 21, causing the engaging portion 41 of the supporting rod 4 to pass through the opening 201 and be elastically inserted into the second fastening groove 322 (see FIG. 13), thereby preventing the folding member 3 from swinging. As the supporting rod 4 moves toward the pivotally connecting portion 21, the upwardly-oriented inclined surface 421 drives the downwardly-oriented inclined surface 51 and hence the trigger element 5 to move upward along the upwardly-oriented inclined surface 421 until the trigger element 5 is back in place (see FIG. 10). With the folding member 3 overlapping the stationary member 2, the pile layer 83 is located on both sides of the duster (see FIG. 15) such that the duster is covered all over with pile threads. The duster in this state can be used to pick up dust from various kinds of dead corners and clean complex surfaces with the dusting sleeve.

According to the above, the trigger element 5 can be operated to allow or prevent the swinging of the folding member 3, and the length of the duster can be controlled by adjusting the swing angle of the folding member 3. Thus, the duster of the present invention is good not only for cleaning large-area surfaces and complex surfaces, but also for removing dust from various kinds of dead corners and small gaps. Now that the problems of the conventional dusters (i.e., the incapability to clean both large-area surfaces and complex surfaces, and the incapability to remove dust from various kinds of dead corners as well as from narrow gaps) are solved, the present invention features enhanced convenience of use. Besides, the dusting sleeve 8, when dirty, can be replaced by a new one while the handle 1, the stationary member 2, and the folding member 3 are kept for use, which is in line with environmental protection requirements.

Further technical features of the present invention are described as follows.

Preferably, the receiving groove 23 has a bottom portion whose inner wall is formed with a notch 232, and the bottom end of the downwardly-oriented inclined surface 51 can move downward into the notch 232. Thus, the distance by which the trigger element 5 can be moved downward is increased.

Preferably, the channel 20 has a bottom portion whose inner wall is formed with a guide groove 202, and the supporting rod 4 has a bottom portion formed with a projection 43 slidably provided in the guide groove 202. The guide groove 202 limits the range of movement of the projection 43 and thus restricts the sliding movement of the supporting rod 4 along the channel 20.

Preferably, the distal end portion 31 of the folding member 3 has a top portion formed with a positioning hole 311, and the stationary member 2 has a top portion formed with an engaging hook 26 adjacent to the handle 1. When the folding member 3 overlaps the stationary member 2, the engaging hook 26 is inserted in the positioning hole 311 to position the folding member 3 in relation to the stationary member 2.

In addition, the pile layer 83 may be provided on the top surface of the sleeve body 81 instead, wherein the pile threads of the pile layer 83 extend outward of the peripheries of the stationary member 2 and the folding member 3. Alternatively, the pile layer 83 may be provided on both the top surface and the bottom surface of the sleeve body 81. In that case, the stationary member 2 and the folding member 3 will be covered all over with pile threads.

Figure 16:
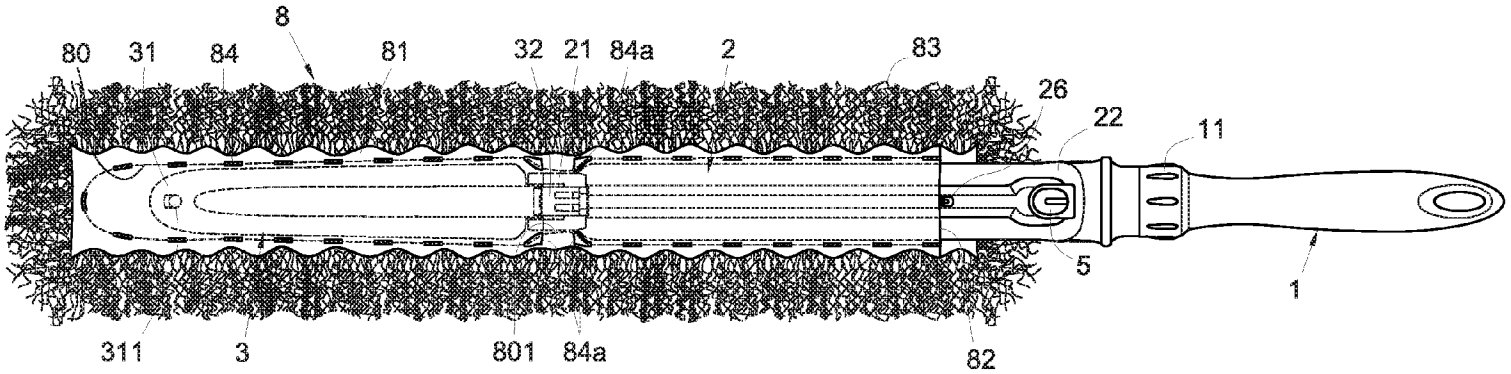
FIG. 16 is a top view similar to FIG. 7 but showing another mode of implementation.

In one embodiment, the receiving space 80 is formed with a neck 801 which is reduced in width in comparison with the receiving space 80, and which is located between the hot-sealed nodes 84*a* on two lateral sides of a middle section of the sleeve body 81 (see FIG. 16). The hot-sealed nodes 84*a* are shaped as polygons extending toward the center of the dusting sleeve 8. The polygons in this embodiment are triangles. After the folding member 3 and the stationary member 2 are inserted into the receiving space 80 through the sleeve opening 82, the neck 801 interferes with movement of the folding member 3 and thereby restricts the folding member 3 in the receiving space 80. In this way, the dusting sleeve 8 is also prevented from coming off the folding member 3 and the stationary member 2.

Figure 17:
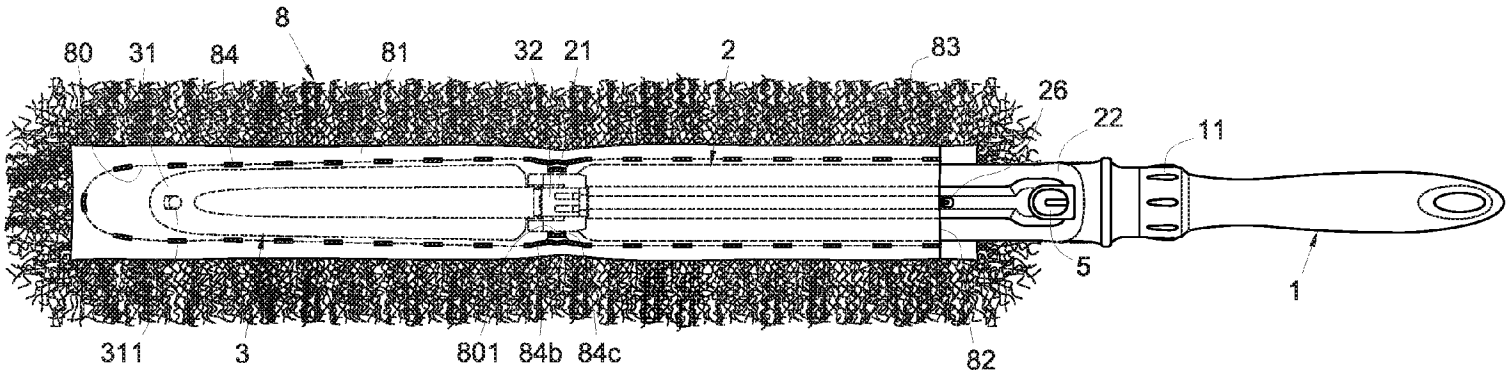
FIG. 17 is a top view similar to FIG. 7 but showing yet another mode of implementation.

Alternatively, referring to FIG. 17, additional hot-sealed nodes 84*c* are provided inward of the hot-sealed nodes 84*b* respectively located on two lateral sides of a middle section of the sleeve body 81. The width-reduced neck 801 in this case is formed between the hot-sealed nodes 84*c*. Each hot-sealed node 84*b* spans the middle section of the sleeve body 81 lengthwise, and the hot-sealed nodes 84*b*, 84*c* are parallel to each other.

In another embodiment, the peripheries of the first and the second cloth sheets 811, 812 of the sleeve body 81 have contours characterized by alternating ridges and grooves (e.g. wavy contours), and the pile threads of the pile layer 83 are unevenly distributed along these contours and are hence fluffier than when the contours are designed otherwise. This fluffy pile layer 83 is ideal for cleaning complex surfaces.

Figure 18:
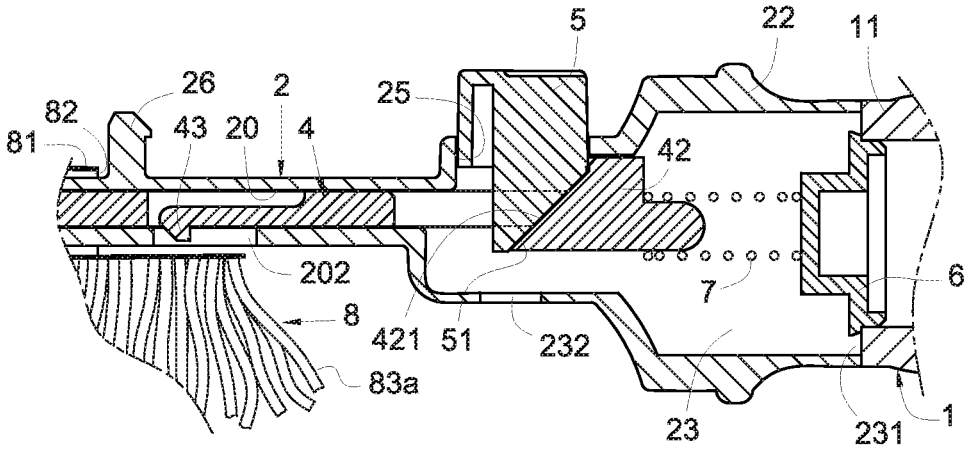
FIG. 18 is a sectional view similar to FIG. 10 but showing another mode of implementation.

Moreover, the outer surface of the sleeve body 81 may be provided with a cloth strip layer 83*a* (see FIG. 18) instead of the pile layer 83, and the cloth strip layer 83*a* may be provided on the bottom surface of the sleeve body 81. Meanwhile, the rest of the components and the method of implementation are the same as those described above.

Figure 19:
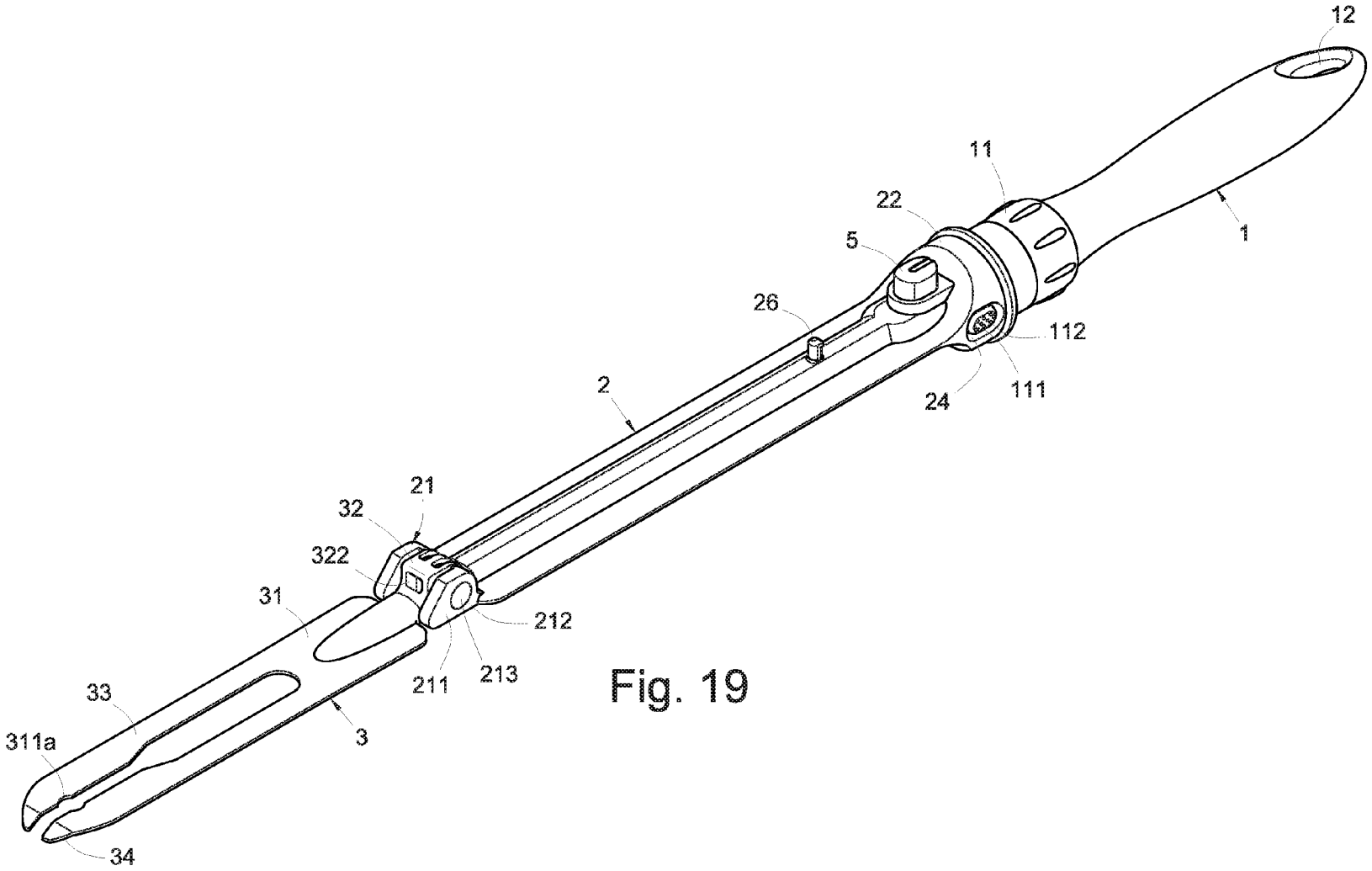
FIG. 19 is a perspective view of the second embodiment of the present invention.
Figure 20:
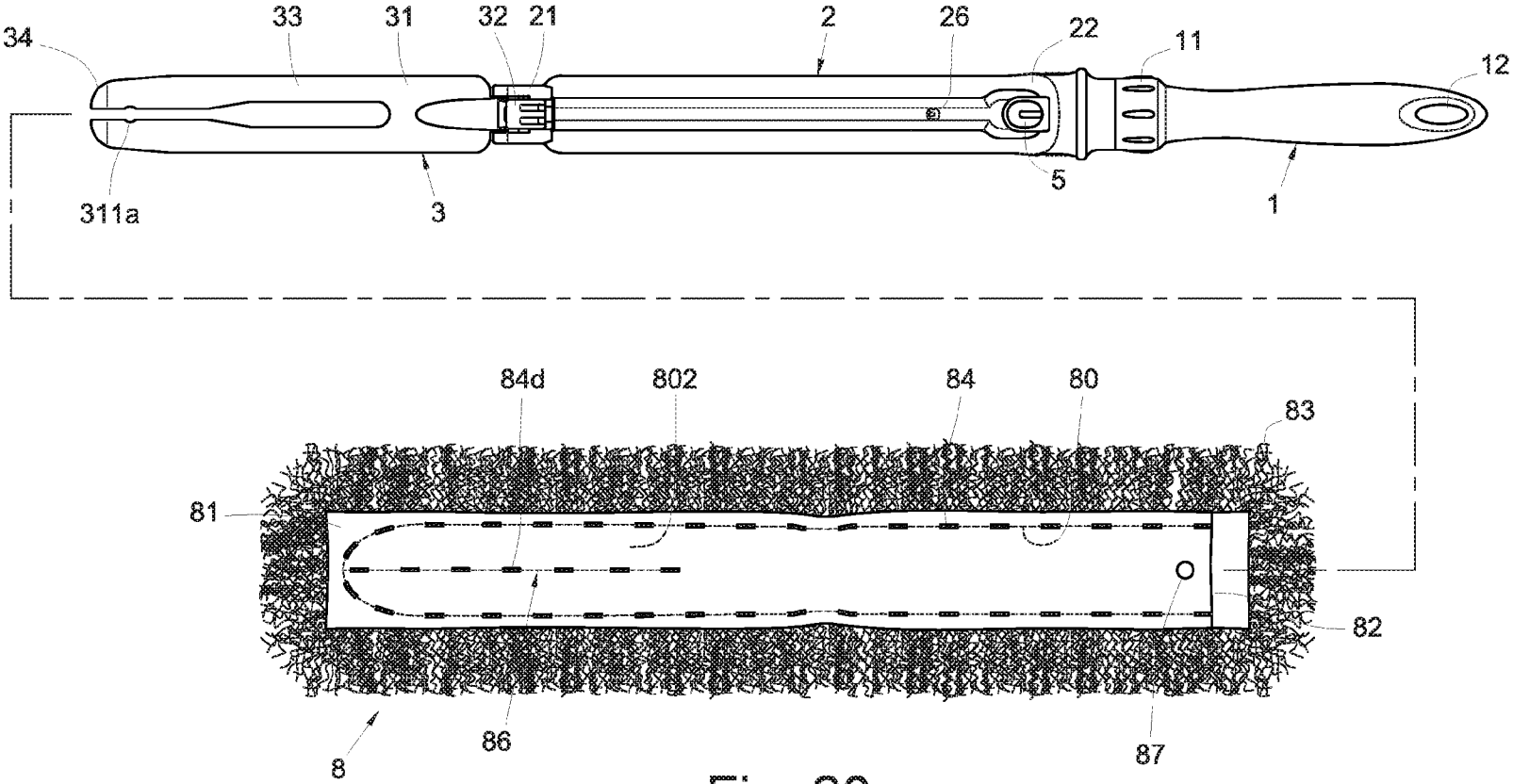
FIG. 20 is an exploded top view of the embodiment shown in FIG. 19.
Figure 21:
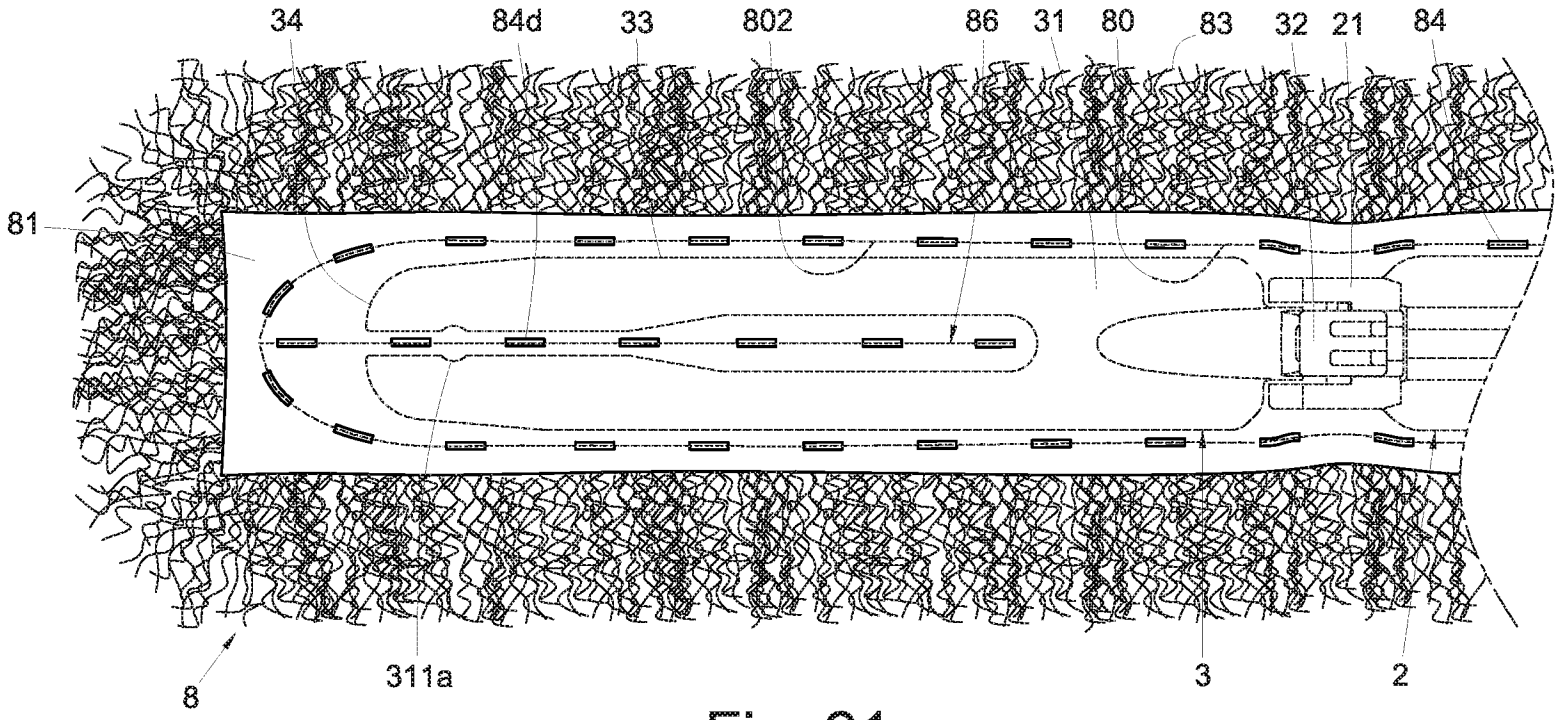
FIG. 21 is a partial assembled top view of FIG. 20.

FIG. 19 is a perspective view of the second embodiment of the present invention. Referring to FIG. 19 in conjunction with FIG. 20 and FIG. 21, a foldable duster according to the present invention includes a handle 1, a stationary member 2, a folding member 3, and a dusting sleeve 8.

The stationary member 2 has two ends which respectively form a pivotally connecting portion 21 and a fastening portion 22 for connecting with the handle 1. The folding member 3 is pivotally connected to the pivotally connecting portion 21. The dusting sleeve 8 has a sleeve body 81 to be mounted around the stationary member 2 and the folding member 3. The outer surface of the sleeve body 81 has a pile layer 83 or a cloth strip layer 83*a* (see FIG. 10, FIG. 11 and FIG. 18). The folding member 3 can be swung to a position where the folding member 3 and the stationary member 2 are arranged along a straight line (see FIG. 6 and FIG. 7), thereby straightening the dusting sleeve 8 and extending the duster to its full length in order to clean large-area surfaces. The folding member 3 can also be swung to a position where it overlaps the stationary member 2 (see FIG. 12 and FIG. 13), thereby folding the dusting sleeve 8 and shortening the duster in order to clean complex surfaces.

The fastening portion 22 has a receiving groove 23 opening toward the handle 1. The inner wall of the receiving groove 23 is formed with two symmetrically arranged end openings 24 which communicate with the outside. One end of the handle 1 has a connecting portion 11 to be inserted into the receiving groove 23. The connecting portion 11 is formed with two symmetrically arranged elastic hooks 111 to be respectively and elastically placed into the end openings 24 and thus be exposed to the outside.

The folding member 3 has two ends which respectively form a distal end portion 31 and a pin portion 32. The folding member 3 is pivotally connected to the pivotally connecting portion 21 of the stationary member 2 by means of the pin portion 32. More specifically, the pin portion 32 has two ends which are respectively formed with a first fastening groove 321 (see FIG. 8) and a second fastening groove 322. The first fastening groove 321 opens in a direction away from the distal end portion 31, whereas the second fastening groove 322 opens toward the distal end portion 31.

A channel 20 is formed in the stationary member 2 and is in communication between the pivotally connecting portion 21 and a portion of the duster that is adjacent to the handle 1. A guide aperture 25 is formed on the duster at a position adjacent to the handle 1 and communicates with the channel 20.

A supporting rod 4 is slidably provided in the channel 20 and is elastically biased toward the pivotally connecting portion 21 so as to pass through the pivotally connecting portion 21 and be elastically inserted into the first fastening groove 321 or the second fastening groove 322, thereby stopping the folding member 3 from swinging.

A trigger element 5 to be triggered by a human hand is provided on the supporting rod 4 and is exposed to the outside through the guide aperture 25. Once triggered, the trigger element 5 drives the supporting rod 4 to disengage from the first fastening groove 321 or the second fastening groove 322 in a direction away from the pivotally connecting portion 21. Thus, the folding member 3 is released and is free to swing.

The receiving groove 23 is formed inside the duster at a position adjacent to the handle 1 and is in communication between the channel 20 and the guide aperture 25. An upwardly-oriented inclined surface 421 is provided on a top portion of the supporting rod 4, faces the folding member 3, and lies in the receiving groove 23. A downwardly-oriented inclined surface 51 is provided on a bottom portion of the trigger element 5 and faces the handle 1. The trigger element 5 is slidably provided on the upwardly-oriented inclined surface 421 of the supporting rod 4 via the downwardly-oriented inclined surface 51. When moved downward, the downwardly-oriented inclined surface 51 drives the upwardly-oriented inclined surface 421 and thereby drives the supporting rod 4 to move away from the pivotally connecting portion 21.

The sleeve body 81 is made by bonding a first cloth sheet 811 and a second cloth sheet 812 together, with a receiving space 80 formed between the first cloth sheet 811 and the second cloth sheet 812. Further, a sleeve opening 82 is formed between one end side of the first cloth sheet 811 and the corresponding end side of the second cloth sheet 812, allowing the folding member 3 and the stationary member 2 to be placed into and drawn out of the receiving space 80 through the sleeve opening 82.

The peripheries of the first cloth sheet 811 and the second cloth sheet 812 are hot-pressed together to form a plurality of hot-sealed nodes 84 and to thereby bond the two cloth sheets together. The pile layer 83 or the cloth strip layer 83*a* is bonded to the bottom surface of the sleeve body 81.

The distal end portion 31 of the folding member 3 forms two parallel insertion legs 33 which extend in a direction away from the pin portion 32. One end of the receiving space 80 is formed with the sleeve opening 82, which is located at one end side of the sleeve body 81, and the other end of the receiving space 80 is formed with two end grooves 802 which are divided from each other and into which the insertion legs 33 can be placed respectively.

The sleeve body 81 is formed, by hot-pressing, with a plurality of hot-sealed nodes 84*d* which correspond in position to the area between the insertion legs 33. These hot-sealed nodes 84*d* constitute a dividing portion 86 for dividing the end grooves 802 from each other. In addition, a positioning hole 311*a* is formed between the insertion legs 33 and corresponds in position to the dividing portion 86. A top portion of the stationary member 2 is formed with an engaging hook 26 which can be inserted into the positioning hole 311*a* along the dividing portion 86. Thus, by means of the positioning hole 311*a*, the folding member 3 can be fastened to the engaging hook 26 of the stationary member 2 and be secured in place.

The sleeve body 81 is formed with a through hole 87 corresponding in position to the engaging hook 26, so as for the engaging hook 26 to extend out of the sleeve body 81 through the through hole 87. On the other hand, the sleeve body 81 can be fastened to the engaging hook 26 of the stationary member 2 and be fixed in position via the through hole 87, preventing the dusting sleeve 8 from coming off the stationary member 2 and the folding member 3.

After the folding member 3 and the stationary member 2 are inserted into the receiving space 80 through the sleeve opening 82, the dividing portion 86 is located between the insertion legs 33, and the insertion legs 33 are inserted in the end grooves 802 respectively. The insertion legs 33 form a tight fit with the inner walls of the end grooves 802 such that the dividing portion 86 is clamped between the insertion legs 33. The rest of the components and the method of implementation are the same as those in the first embodiment.

Preferably, the insertion legs 33 are plate-shaped and are flexible. Thus, when the dusting sleeve 8 supported by the folding member 3 is used to clean the surface of an object, the flexibility of the insertion legs 33 enables application of force to the surface of the object to be cleaned.

Preferably, the end of the folding member 3 that is away from the pivotally connecting portion 21 of the stationary member 2 is formed with a bent portion 34 which is bent downward. When it is desired to insert the distal end portion 31 and the insertion legs 33 of the folding member 3 into the receiving space 80 through the sleeve opening 82, the bent portion 34 can be used to lift open the sleeve opening 82, thereby allowing easy insertion of the distal end portion 31 and the insertion legs 33 into the sleeve opening 82. Besides, when it is desired to lift the folded folding member 3 away from the stationary member 2, the bent portion 34 facilitates gripping and makes it easy to pull the folding member 3 and the stationary member 2 apart.

According to the above, the insertion legs 33, the end grooves 802, the dividing portion 86, and the through hole 87 are designed to further prevent the dusting sleeve 8 from coming off the folding member 3 and the stationary member 2, and the plate-shaped insertion legs 33 provide enhanced flexibility to the folding member 3, allowing the front end of the folding member 3 to be readily inserted into a narrow gap to remove dust therefrom.

The present invention has the following advantages over the prior art:

1. The handle 1 has a cylindrical shape that is easy to grip. The cylindrical handle 1 also facilitates 360-degree rotation.

2. When the folding member 3 is folded against the stationary member 2 such that the duster is shortened, the duster is covered all over with pile threads or a plurality of cloth strips and is therefore suitable for cleaning various kinds of complex surfaces. Also, the duster can be maneuvered and stored with ease in this folded state.

3. When the folding member 3 and the stationary member 2 are unfolded to extend the duster to its full length, the pile layer 83 or the cloth strip layer 83*a* is located on a single side of the duster, thus giving the duster a relatively small thickness. Furthermore, when the duster is extended at full length, the length along which the pile threads or the cloth strips are distributed is relatively great. Therefore, the duster in the unfolded state not only can be easily inserted into tiny gaps to be cleaned, but also can be used to clean large-area surfaces. In this way, convenience of use and cleaning efficiency are both increased.

4. The engagement between the engaging hook 26 and the positioning hole 311 effectively secures the folding member 3 and the stationary member 2 in place, preventing the folding member 3 from getting loose from the stationary member 2.

5. The configuration of the duster can be effectively fixed during use by engagement between the supporting rod 4 and the first or the second fastening groove 321, 322. Once the supporting rod 4 is disengaged from the first or the second fastening groove 321, 322, the folding member 3 is free to swing with respect to the stationary member 2.

What is claimed is:

1. A foldable duster, comprising:

a handle;

a stationary member having two ends respectively forming a pivotally connecting portion and a fastening portion for connecting with the handle;

a folding member pivotally connected to the pivotally connecting portion; and a dusting sleeve having a sleeve body to be mounted around the stationary member and the folding member, the sleeve body having an outer surface having either a pile layer or a cloth strip layer, the folding member being able to be swung to a position where the folding member and the stationary member are arranged along a straight line such that the dusting sleeve is straightened and the duster is extended at full length in order to clean a large-area surface, the folding member also being able to be swung to a position where the folding member overlaps the stationary member such that the dusting sleeve is folded and the duster is shortened in order to clean a complex surface;

wherein the fastening portion has a receiving groove opening toward the handle, the receiving groove having an inner wall formed with two symmetrically arranged end openings in communication with outside, the handle having an end having a connecting portion to be inserted into the receiving groove, the connecting portion being formed with two symmetrically arranged elastic hooks, the hooks being configured to be placed in the end openings respectively and elastically and thus be exposed to the outside.

2. The foldable duster of claim 1, wherein the sleeve body is composed of a first cloth sheet and a second cloth sheet bonded together such that a receiving space is formed between the first cloth sheet and the second cloth sheet, there being a sleeve opening formed between an end side of the first cloth sheet and an corresponding end side of the second cloth sheet, the sleeve opening being in communication with the receiving space so that the folding member and the stationary member can be placed into and drawn out of the receiving space through the sleeve opening.

3. The foldable duster of claim 2, wherein a periphery of the first cloth sheet and a periphery of the second cloth sheet are hot-pressed together to form a plurality of hot-sealed nodes, thereby bonding the first cloth sheet and the second cloth sheet together, and the receiving space is formed with a width-reduced neck which is located between said hot-sealed nodes on two lateral sides of a middle section of the sleeve body and which is configured for interfering with movement of the folding member.

4. The foldable duster of claim 1, wherein the pile layer or the cloth strip layer is bonded to a bottom surface of the sleeve body.

5. The foldable duster of claim 1, wherein the sleeve body has a periphery having a contour characterized by alternating ridges and grooves, and the pile layer or the cloth strip layer is unevenly distributed along the contour characterized by the alternating ridges and grooves.

6. The foldable duster of claim 1, wherein the folding member has two ends respectively having a distal end portion and a pin portion, the folding member being pivotally connected to the pivotally connecting portion via the pin portion, the distal end portion forming two insertion legs extending in a direction away from the pin portion, the sleeve body having a receiving space therein, the receiving space having an end formed with a sleeve opening located at an end side of the sleeve body so that the folding member and the stationary member can be placed into and drawn out of the receiving space through the sleeve opening, the receiving space having an opposite end formed with two end grooves divided from each other so that the insertion legs can be placed in the end grooves respectively.

7. The foldable duster of claim 6, wherein the sleeve body is formed, by hot-pressing, with a plurality of hot-sealed nodes corresponding in position to an area between the insertion legs, the hot-sealed nodes constituting a dividing portion for dividing the end grooves from each other, there being a positioning hole formed between the insertion legs and corresponding in position to the dividing portion, the stationary member having a top portion formed with an engaging hook to be inserted into the positioning hole along the dividing portion.

8. The foldable duster of claim 1, wherein the folding member has an end which is away from the pivotally connecting portion and which forms a bent portion.

9. A foldable duster, comprising:

a handle;

a stationary member having two ends respectively forming a pivotally connecting portion and a fastening portion for connecting with the handle;

a folding member pivotally connected to the pivotally connecting portion; and a dusting sleeve having a sleeve body to be mounted around the stationary member and the folding member, the sleeve body having an outer surface having either a pile layer or a cloth strip layer, the folding member being able to be swung to a position where the folding member and the stationary member are arranged along a straight line such that the dusting sleeve is straightened and the duster is extended at full length in order to clean a large-area surface, the folding member also being able to be swung to a position where the folding member overlaps the stationary member such that the dusting sleeve is folded and the duster is shortened in order to clean a complex surface;

wherein the folding member has two ends respectively having a distal end portion and a pin portion, the folding member being pivotally connected to the pivotally connecting portion via the pin portion, the pin portion having two ends respectively formed with a first fastening groove and a second fastening groove, the first fastening groove opening in a direction away from the distal end portion, the second fastening groove opening toward the distal end portion, the duster further comprising:

a channel formed in the stationary member and being in communication between the pivotally connecting portion and a portion of the duster that is adjacent to the handle;

a guide aperture formed on the duster at a position adjacent to the handle, the guide aperture being in communication with the channel;

a supporting rod slidably provided in the channel and being elastically biased toward the pivotally connecting portion so as to pass through the pivotally connecting portion and be elastically inserted into the first fastening groove or the second fastening groove, thereby stopping the folding member from swinging; and a trigger element provided on the supporting rod and being exposed to outside through the guide aperture so as to be triggered by a human hand, wherein the trigger element, once triggered, drives the supporting rod to disengage from the first fastening groove or the second fastening groove in a direction away from the pivotally connecting portion, thereby releasing the folding member and allowing the folding member to swing.

10. The foldable duster of claim 9, further comprising:

a receiving groove formed in the duster at a position adjacent to the handle, the receiving groove being in communication between the channel and the guide aperture;

an upwardly-oriented inclined surface provided on a top portion of the supporting rod, facing the folding member, and lying in the receiving groove; and a downwardly-oriented inclined surface provided on a bottom portion of the trigger element and facing the handle, the trigger element being slidably provided on the upwardly-oriented inclined surface via the downwardly-oriented inclined surface, wherein the downwardly-oriented inclined surface, once moved downward, drives the upwardly-oriented inclined surface and thereby drives the supporting rod to move in the direction away from the pivotally connecting portion.

11. A foldable duster, comprising:

a handle;

a stationary member having two ends respectively forming a pivotally connecting portion and a fastening portion for connecting with the handle;

a folding member pivotally connected to the pivotally connecting portion; and a dusting sleeve having a sleeve body to be mounted around the stationary member and the folding member, the sleeve body having an outer surface having either a pile layer or a cloth strip layer, the folding member being able to be swung to a position where the folding member and the stationary member are arranged along a straight line such that the dusting sleeve is straightened and the duster is extended at full length in order to clean a large-area surface, the folding member also being able to be swung to a position where the folding member overlaps the stationary member such that the dusting sleeve is folded and the duster is shortened in order to clean a complex surface;

wherein the folding member has a top portion formed with a positioning hole, and the stationary member has a top portion formed with an engaging hook configured to be inserted into the positioning hole.

12. The foldable duster of claim 11, wherein the sleeve body is formed with a through hole which corresponds in position to the engaging hook and through which the engaging hook can extend out of the sleeve body such that the sleeve body is fastened to the engaging hook of the stationary member and is secured in place via the through hole.

* * * * *